United States Patent [19]

Wolf et al.

[11] 4,449,497

[45] May 22, 1984

[54] CAPACITOR DISCHARGE IGNITION SYSTEM

[75] Inventors: Ronald J. Wolf, Zanesville; Richard F. Jereb, Fort Wayne; Mark Farmer, Farmersburg, all of Ind.

[73] Assignee: Wabash, Inc., Huntington, Ind.

[21] Appl. No.: 401,232

[22] Filed: Jul. 23, 1982

[51] Int. Cl.[3] ..... F02P 9/00

[52] U.S. Cl. ..... 123/335; 123/599; 123/600

[58] Field of Search ..... 123/335, 198 DC, 600, 123/599, 630

[56] References Cited

U.S. PATENT DOCUMENTS

| | | | |
|---|---|---|---|
| 3,703,889 | 11/1972 | Bodig et al. | 123/198 DC |
| 4,010,726 | 3/1977 | Kondo et al. | 123/599 |
| 4,186,711 | 2/1980 | Jörg | 123/630 |
| 4,195,603 | 4/1980 | Decker et al. | 123/418 |
| 4,252,095 | 2/1981 | Jaulmes | 123/329 |
| 4,282,839 | 8/1981 | Newberry et al. | 123/335 |
| 4,324,215 | 4/1982 | Sieja | 123/335 |
| 4,343,273 | 8/1982 | Kondo et al. | 123/335 |
| 4,404,940 | 9/1983 | Sieja | 123/335 |

FOREIGN PATENT DOCUMENTS 555450 1/1980 Japan .

*Primary Examiner*—Andrew M. Dolinar
*Attorney, Agent, or Firm*—Mason, Kolehmainen, Rathburn & Wyss

[57] ABSTRACT

A capacitor discharge ignition system is provided with a control arrangement to prevent operation of an engine at excessive speeds. For example, when the engine exceeds a predetermined speed of operation, the control arrangement is effective to terminate the generation of the ignition firing pulses to the spark plug of the engine. The control arrangement includes a capacitor connected at one end to the cathode of an SCR switching device that controls the discharge of a charging capacitor into an ignition coil. The other end of the capacitor is connected in the triggering circuit of the SCR. The capacitor discharge ignition system is arranged to charge the charging capacitor during a first half cycle of operation of one polarity and subsequently to discharge the capacitor into the ignition coil by triggering the SCR during the following half cycle of operation of opposite polarity. The charging of the capacitor and the triggering of the SCR are controlled by voltage and current waveforms generated by a control winding that is disposed on a ferromagnetic core. The ferromagnetic core is positioned adjacent the rotating magnetic field that is developed for example by a permanent magnet carried by the flywheel of the engine.

15 Claims, 2 Drawing Figures

CAPACITOR DISCHARGE IGNITION SYSTEM

BACKGROUND OF THE INVENTION

1. Field of the Invention

The present invention relates generally to capacitor discharge ignition systems and more particularly to control arrangements to provide speed control of engines. 2. Description of the Prior Art Various capacitor discharge ignition systems of the prior art have been developed to provide engine speed control and selective engine cut-off controls. A first category of CDI systems of the prior art utilize ignition timing control for the control of engine speed as for example as disclosed in U.S. Pat. No. 4,228,780 and in copending application Ser. No. 488,212 filed by Ronald J. Wolf on Apr. 25, 1983 which is a continuation in part application of Ser. Nos. 331,293 and 382,679 now abandoned, and as further disclosed in prior art patents cited therein. A second category of prior art CDI systems provide engine cut-off controls either by means of a kill switch connected directly to the charging source or by shut-off coils that are selectively switched in and out of the circuit. For example, U.S. Pat. No. 3,941,110 to Sekigushi discloses in FIG. 3 a kill switch that is closed to short circuit the generating supply that charges the charging capacitor. U.S. Pat. Nos. 3,894,524 and 3,960,128 disclose arrangements where a separate shut-off coil is selectively switched in and out of the circuit to provide shut off signals in a triggering network of the switching device. A third category of prior art CDI systems include control arrangements for limiting the speed of an engine, for example, as disclosed in U.S. Pat. Nos. 3,941,110 and 3,703,889.

U.S. Pat. No. 3,941,110 to Sekigushi is directed to a CDI system that includes in the embodiment of FIG. 5 an arrangement for preventing excessive rotation of the engine. A switching element controlling means 55 for an SCR switching element includes a monostable multivibrator 551 that outputs a trigger current signal over a time interval $t_g$. The CDI system is arranged to operate in a fire-charge sequence. As the engine speed becomes excessive, the trigger current signal $t_g$ is maintained as shown in FIG. 7 until the charge phase such that the charge capacitor is not charged since the charging circuit is short circuited by the SCR switching element.

U.S. Pat. No. 3,703,889 to Bodig et al discloses a speed limiting arrangement for a CDI system wherein an RPM dependent control voltage is generated and applied to the control SCR. When a predetermined engine speed is exceeded, the SCR is triggered when the charge winding supplies charging current to the ignition capacitor 11. Thus, the ignition capacitor is shunted. The engine speed dependent control voltage is generated by an additional magnet 40 on the flywheel that creates a weaker magnetic field than the magnet that induces the charging voltage in the charging winding. The magnet 42 is arranged to induce the charging voltage in the charging winding 15 and to induce a trigger voltage in the primary winding of the ignition transformer to trigger the control SCR to discharge the capacitor 11 at the primary winding.

While the above described arrangements of the prior art are generally suitable for their intended use, it would be desirable to provide an improved and simplified engine speed control arrangement for a CDI system.

SUMMARY OF THE INVENTION

It is a principal object of the present invention to provide a capacitor discharge ignition system including an improved engine speed control arrangement.

It is another object of the present invention to provide an engine speed control arrangement in a capacitor discharge ignition system that prevents excessively high engine speeds and that terminates the generation of ignition firing pulses when a predetermined engine speed is exceeded.

It is another object of the present invention to provide a capacitor discharge ignition system that maintains the conductive stage of a switching element that controls the discharge of a charging capacitor into an ignition transformer when a predetermined ignition speed is exceeded, the switching element being controlled by a triggering network including an engine speed control circuit.

It is a further object of the present invention to provide a capacitor discharge ignition system including an improved engine speed control arrangement that is temperature compensated resulting in stabilized engine speed control over a wide operating temperature range.

Briefly, these and other objects of the present invention are achieved by providing capacitor discharge ignition system with a control arrangement to prevent operation of an engine at excessive speeds. For example, when the engine exceeds a predetermined speed of operation, the control arrangement is effective to terminate the generation of the ignition firing pulses to the spark plug of the engine. The control arrangement includes a capacitor connected at one end to the cathode of an SCR switching device that controls the discharge of a charging capacitor into an ignition coil. The other end of the capacitor is connected in the triggering circuit of the SCR. The capacitor discharge ignition system is arranged to charge the charging capacitor during a first half cycle of operation of one polarity and subsequently to discharge the capacitor into the ignition coil by triggering the SCR during the following half cycle of operation of opposite polarity. The charging of the capacitor and the triggering of the SCR are controlled by voltage and current wave-forms generated by a control winding that is disposed on a ferromagnetic core. The ferromagnetic core is positioned adjacent the rotating magnetic field that is developed for example by a permanent magnet carried by the flywheel of the engine.

BRIEF DESCRIPTION OF THE DRAWING

The invention both as to its organization and method of operation together with further objects and advantages thereof will best be understood by reference to the following specification taken in connection with the accompanying drawing wherein.

DESCRIPTION OF THE PREFERRED EMBODIMENT

Figure 1:
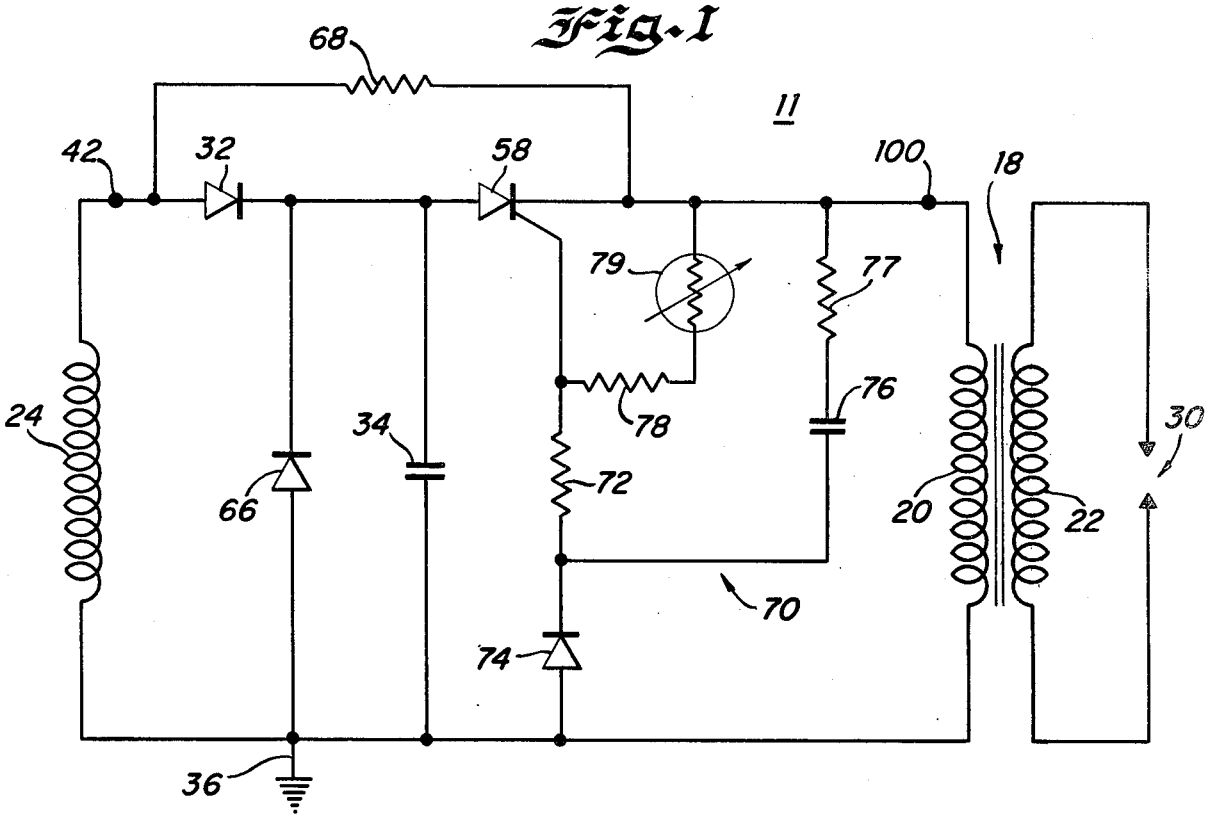
FIG. 1 is an electrical schematic diagram of a preferred embodiment of the capacitor discharge ignition system of the present invention.

Referring now to FIG. 1, the capacitor discharge ignition (CDI) system of the present invention referred to generally at 11 includes a speed control arrangement for preventing excessive engine speed operation and is an improvement of the CDI system disclosed in U.S. Pat. No. 4,228,780 which issued to Ronald J. Kiess on Oct. 21, 1980 and which is hereby incorporated by reference for all purposes. The operation and structure of the CDI system 11 is similar in general respects to the CDI system 10 disclosed in U.S. Pat. No. 4,228,780 and reference may be made to that patent for a more complete discussion of the structure and general operation of the CDI system 11 and the operative positioning of the CDI system 11 with respect to a flywheel of an engine to be controlled.

Referring now to FIG. 1 of U.S. Pat. No. 4,228,780, the CDI system 10 disclosed therein or the CDI system 11 of the present invention is operatively positioned adjacent the flywheel 12 of an engine. The flywheel 12 carries a permanent magnet referred to generally at 15 that energizes and controls the basic timing of the CDI system 10 upon rotation of the flywheel 12. The permanent magnet 15 includes two magnet pole faces or pieces 17 and 19. The embodiment of the CDI system illustrated in FIG. 1 of U.S. Pat. No. 4,228,780 includes a generally U-shaped stator core 14. Further it should also be understood that the CDI system 11 of the present invention in various embodiments includes other multiple legged configurations of the core 14.

In FIG. 1 of the present invention, like reference numerals refer to like components referred to in U.S. Pat. No. 4,228,780. A control coil 16 and an ignition coil 18 are disposed on one leg of the stator core 14 in the arrangement of FIG. 1 of U.S. Pat. No. 4,228,780. The control coil 16 includes a control winding 24 and the ignition coil 18 includes a primary winding 20 and a secondary winding 22. In a specific embodiment, the primary winding and the secondary winding 22 are concentrically arranged on the stator core 14 with the control coil 16 disposed along the stator core 14 adjacent the ignition coil 18.

The ignition coil 18 of the CDI system 11 of the present invention is arranged to fire a spark plug generally indicated at 30 and connected across the secondary winding 22. The control winding 24 at one end referred to at reference point 42 is connected through a diode 32 arranged anode to cathode to one end of a charging capacitor 34. The other end of the capacitor 34 and the other end of the control winding 24 are connected to a ground reference indicated generally at 36.

The primary winding 20 is connected between the ground reference 36 and the cathode of an SCR switching element 58 at reference point 100. The junction of the charging capacitor 34 and the cathode of diode 32 is connected to the anode of the SCR 58. A resistor 68 is connected between the coil end 42 of the control winding 24 and the cathode of the SCR 58. A diode 66 is connected anode to cathode between the ground reference 36 and the anode of the SCR 58.

In accordance with important aspects of the present invention, a speed control circuit referred to generally at 70 is connected to the gate or control electrode of the SCR 58. In addition to engine speed control, the circuit 70 also functions to control the triggering of the SCR 58 to discharge the capacitor 34 into the primary winding 20 of the ignition coil 18. The discharge of the capacitor 34 into the primary winding 20 induces a high voltage pulse in the secondary winding 22 of the ignition coil 18 to provide the appropriate power conditions to fire the spark plug connected at 30 across the secondary winding 22.

The speed control circuit 70 includes the series combination of a resistor 72 and a diode 74 arranged cathode to anode connected between the gate or control electrode of the SCR 58 and the ground reference 36. The speed control circuit 70 also includes a capacitor 76 connected at one end to the cathode of the SCR 58 and at the other end to the junction between the resistor 72 and the diode 74. In a specific embodiment, a resistor 77 is provided in series with the capacitor 76 to control the charge rate of the capacitor 76. However, it should be understood that the resistor 77 is optional in the preferred embodiment.

In the preferred embodiment and in accordance with further aspects of the present invention, the speed control circuit 70 also includes a temperature compensation arrangement provided by the series combination of a resistor 78 and a thermistor 79 connected between the cathode of the SCR 58 and the gate or control electrode of the SCR 58.

For normal engine operation for engine speeds below a predetermined speed, the operation of the CDI system 11 is as generally described in the U.S. Pat. No. 4,228,780 and as illustrated by the depicted waveforms in FIG. 3 of that patent and the timing curve 92 of FIG. 4 of that patent.

During normal engine speed operation below the predetermined speed, the capacitor 76 is charged in response to the voltage waveform 81 and the current waveform 82 as shown in FIG. 3 of U.S. Pat. No. 4,228,780 in response to the induced voltages in the control winding 24. The SCR 58 is triggered to discharge the capacitor 34 into the primary winding 20. The capacitor 34 is charged in response to the voltage waveform 40 and the current waveform 44 generated by the control winding 24 and occurring prior to the opposite polarity waveforms 81 and 82. Further, the capacitor 76 is also charged in response to the waveforms 81 and 82 and in accordance with the component values of the control circuit 70.

After the triggering of the SCR 58 and after movement of the magnet 15 past the CDI system 11, the capacitor 76 discharges in accordance with the time constants of the components of the control arrangement 70 and the circuitry of the CDI system 11. Thus, on the next revolution of the flywheel 12 and prior to the next charging cycle, the capacitor 76 has discharged and the SCR 58 is non-conductive at this time. Subsequently, and again considering normal engine speed operation below a predetermined speed, the normal charging cycle represented by the waveforms 40 and 44 and the normal discharge or triggering cycle represented by the waveforms 81 and 82 take place with normal operation of the CDI system 11 to again provide the appropriate power conditions to fire the spark plug connected at 30 across the secondary winding 22.

Considering now operation of the CDI system 11 as a predetermined engine speed is exceeded, the capacitor 76 remains sufficiently charged from one cycle of operation after the SCR 58 is triggered so as to maintain the SCR 58 in the conductive state during the next revolution of the flywheel 12 as the next charging cycle occurs. With the SCR 58 conductive, the capacitor 34 is not charged and instead the charging current through diode 32 is shunted from the capacitor 34 through the SCR 58 and into the primary winding 20. Of course, the CDI system 11 is arranged such that the current delivered to the primary winding 20 is insufficient to cause firing of the spark plug at 30. With an engine speed greater than the predetermined speed, the capacitor 76 is again charged during the discharge or triggering cycle of waveforms 81 and 82 and the SCR 58 is again maintained in the conductive state for the next revolution of the flywheel 12 in the next successive charging cycle. Thus, as long as the engine speed is greater than the predetermined speed, capacitor 34 is not charged and the spark plug at 30 is not fired.

Without the firing of the spark plug 30, the engine will eventually slow below the predetermined speed and normal ignition operations will resume with the firing of the spark plug at 30. Thus, normal operation will resume as described hereinbefore with engine speed below the predetermined speed.

Thus, the speed control arrangement 70 prevents excessive engine speed operation above a predetermined speed; the predetermined speed being selected by the component values of the speed control arrangement 70 and the components of the CDI system 11. The predetermined speed, for example, is the desired maximum engine speed. For example, for one specific type of engine, the predetermined speed is selected in the range of 8500–9000 rpm and the speed control circuit 70 terminates ignition of the spark plug at 30 when this speed is exceeded by the engine.

In addition to the component values of the speed control arrangement 70, it should also be understood that the predetermined speed is also effected by the amplitude of the waveforms 81 and 82 generated by the control winding 24 as well as the rate of charge provided by the operative arrangement of the CDI system 11 with respect to the permanent magnet 15 and the rotating flywheel 12. For example, the defined air gap between the stator core 14 and the permanent magnet 15 effect the rate of charge. Thus, changes in the air gap dimension will effect the predetermined speed at which ignition is terminated. For example, with one specific type of engine, air gap variations between zero and 0.020 inches have been found to result in a variation of 1000–1500 rpm in the predetermined speed of ignition termination. Further it should be understood that the diameter of the flywheel 12 effects the rate of charge to the control arrangement 70. Additionally, the component values of capacitor 76 and resistors 72 and 68 are chosen to obtain the desired speed control for various engine applications.

While a predetermined engine speed has been discussed hereinbefore, it should be understood that in specific embodiments of the present invention the transistion from normal firing of the spark plug at 30 for each revolution of the flywheel 12 and complete termination of ignition voltages may actually take place in a relatively narrow range of engine speed variation such as 200–500 rpm. Further it should also be understood that in certain specific embodiments, the resistor 78 may be omitted.

The combination of the resistor 78 and the thermistor 79 are arranged to compensate for variations in triggering sensitivity of the SCR 58 over a wide operating temperature range. Specifically, the resistor 78 and the thermistor 79 provide a shunt current path across the gate to cathode function of the SCR 58. Thus, with increasing temperatures as the SCR 58 requires lower gate currents for triggering, the resistor 78 and the thermistor 79 provide a compensating increase in the shunted current.

Figure 2:
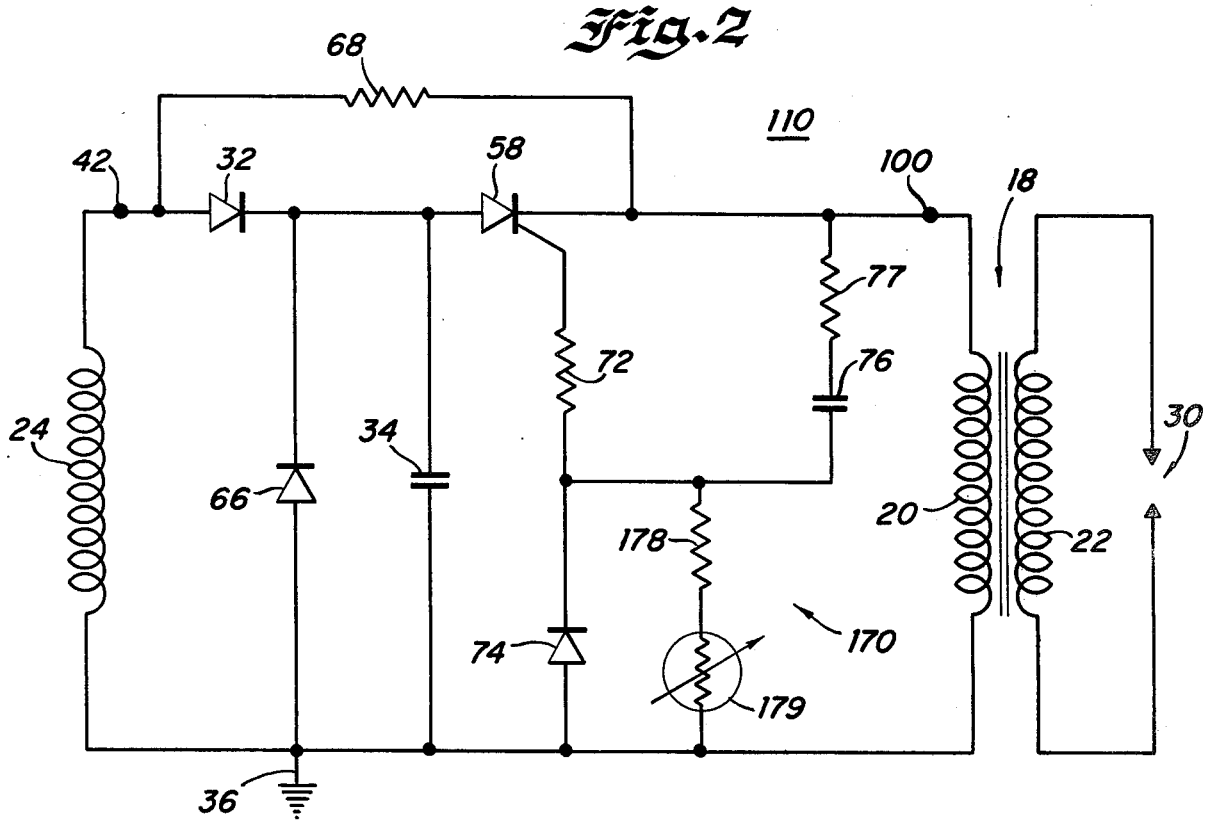
FIG. 2 is an electrical schematic diagram of an alternate embodment of the capacitor discharge system of the present invention.

Referring now to FIG. 2 where like reference numerals refer to like components of FIG. 1, an alternate embodiment 110 of the capacitor discharge ignition system of the present invention includes a speed control circuit 170 functioning in a manner similar to the speed control circuit 70 of FIG. 1. The speed control circuit 170 includes a temperature compensation arrangement provided by the series combination of a resistor 178 and a thermistor 179 connected between the ground reference 36 and the junction of the resistor 72 and the diode 74.

While there has been illustrated and described various embodiments of the present invention, it will be apparent that various changes and modifications thereof will occur to those skilled in the art. It is intended in the appended claims to cover all such changes and modifications as fall within the true spirit and scope of the present invention.

What is claimed and desired to be secured by letters patent of the United States is:

1. In a capacitor discharge ignition system for use with and for positioning adjacent a flywheel of an engine that generates a rotating magnetic field provided by a permanent magnet carried by the flywheel, the combination of:

means for generating in response to each passage of the permanent magnet and in operative sequence a charging supply and a triggering supply in response to induced voltages and currents resulting from the rotating magnetic field, said generating means comprising a control winding;

ignition coil means for receiving energy and for generating an ignition voltage in response to received energy; and means responsive to said generating means and being charged in response to said charging supply for storing said energy delivered from said charging supply and for controlling the discharge of said stored energy into said ignition coil means, said storing and discharge controlling means comprising engine speed control means for inhibiting the charging of said storing and discharge controlling means when the speed of the engine exceeds a predetermined speed, said storing and discharge controlling means comprising electronic switch means having a control connection, said engine speed control means comprising resistive-capacitive circuit means being connected to said triggering supply and said control connection for rendering said electronic switch means conductive to discharge said stored energy into said ignition coil means when the speed of the engine is less than said predetermined speed and for maintaining said electronic switch means conductive when the speed of the engine exceeds said predetermined speed from one revolution of the flywheel to the next revolution of the flywheel and from one occurrence of said triggering supply throughout at least the duration of the next occurrence of said charging supply.

2. The combination of claim 1 wherein said engine speed control means further comprises temperature compensation means for stabilizing operation of said engine speed control means to reduce variations over a range of operating temperatures in the speed at which said storing and discharge controlling means is inhibited.

3. The combination of claim 1 or 2 wherein said resistive-capacitive circuit means comprises a capacitor that is charged in response to said triggering supply.

4. The combination of claim 3 wherein said temperature compensation means comprises thermistor means to compensate for variations in the triggering sensitivity of said electronic switch means with respect to temperature.

5. The combination of claim 1 wherein said ignition coil includes a primary winding and a secondary winding and said storing and discharge controlling means comprises a charging capacitor connected in a series circuit loop with the switch path of said electronic switch means and said primary winding.

6. The combination of claim 5 wherein said generating means is connected across said charging capacitor.

7. The combination of claim 5 wherein said electronic switch means includes an anode connection and a cathode connection defining a switch path, said resistive-capacitive circuit means comprising a capacitor being connected between said cathode connection and said control connection of said electronic switch means.

8. The combination of claim 7 wherein said engine speed control means further comprises unidirectional current passing means connected between one end of said control winding and said control connection for providing a unidirectional current path between said control winding and said control connection.

9. The combination of claim 7 wherein said resistive-capacitive circuit means further comprises resistive means for defining in combination with said capacitor an RC time constant to determine the discharge time of said capacitor.

10. The combination of claim 7 wherein said engine speed control means further comprises temperature compensation means for stabilizing operation of said engine speed control means to reduce variation with temperature in the speed at which said storing and discharge controlling means in inhibited.

11. The combination of claim 7 or 10 wherein said resistive capacitive circuit means further comprises resistive means being connected between said control connection of said electronic switch means and said capacitor.

12. The combination of claim 10 wherein said temperature compensation means is connected between said cathode and control connection of said electronic switch means.

13. The combination of claim 10 wherein said temperature compensation means is connected between said triggering supply and said control connection.

14. In a capacitor discharge ignition system for use with and positioned adjacent a flywheel of an engine that generates a rotating magnetic field provided by a permanent magnet carried by the flywheel, the combination of:

means for generating in response to each passage of the permanent magnet and in operative sequence a charging supply and a triggering supply in response to induced voltages and currents resulting from the rotating magnetic field, said generating means comprising a control winding;

storage means connected to said generating means and being charged in response to said charging supply for storing energy delivered from said charging supply;

ignition coil means comprising a primary winding and a secondary winding;

electronic switch means having a controlled conduction path connected between said storage means and said primary winding and a control connection for controlling the state of said controlled conduction path; and engine speed control means connected between a first end of said control winding and said electronic switch means for controlling the state of said controlled conduction path, said control winding, said controlled conduction path and said primary winding being connected in a series circuit loop, said engine speed control means comprising a diode having an anode connected to a first end of said control winding, said engine speed control means further comprising a resistive-capacitive network means having three circuit connections, a first of said circuit connections being connected to said cathode of said diode, a second connection of said three circuit connections being connected to said control connection of said electronic switch means, and the third of said control connections being connected to one end of said controlled conduction path, said engine speed control means rendering said controlled conduction path conductive in response to said triggering supply to discharge said storage means into said primary winding and maintaining said controlled conduction path conductive when the engine exceeds a predetermined speed at least throughout the duration of the next occurring charging supply.

15. The combination of claim 14 wherein said electronic switch means comprises an anode connected to said storage means and a cathode connected to said primary winding, said resitive-capacitive network means comprising a resistor being connected between said cathode of said diode and said control connection of said electronic switch means and a capacitor connected between said cathode of said diode and said cathode of said electronic switch means.

* * * * *